United States Patent [19]

Murray et al.

[11] 4,227,337

[45] Oct. 14, 1980

[54] TOY BUILDING UNITS

[75] Inventors: Dale L. Murray, Hopkins; Jerry L. Dohse, St. Louis Park, both of Minn.

[73] Assignee: Tonka Corporation, Spring Park, Minn.

[21] Appl. No.: 10,795

[22] Filed: Feb. 9, 1979

[51] Int. Cl.[2] ..... A63H 33/08

[52] U.S. Cl. ..... 46/12; 46/19

[58] Field of Search ..... 46/12, 19, 21

[56] References Cited

U.S. PATENT DOCUMENTS

| | | | |
|---|---|---|---|
| 2,036,802 | 4/1936 | Fleishman et al. | 46/12 |
| 2,407,927 | 9/1946 | Hayden | 46/19 |
| 2,569,107 | 9/1951 | Johnson | 46/19 |
| 2,639,545 | 5/1953 | Pastorius | 46/12 X |
| 2,776,522 | 1/1957 | Schramm et al. | 46/39 |
| 3,080,674 | 3/1963 | Amici | 46/25 |
| 3,415,007 | 12/1968 | Höwe | 46/19 |

FOREIGN PATENT DOCUMENTS

| | | | |
|---|---|---|---|
| 602476 | 9/1934 | Fed. Rep. of Germany | 46/19 |
| 879070 | 6/1953 | Fed. Rep. of Germany | 46/12 |

*Primary Examiner*—F. Barry Shay

*Attorney, Agent, or Firm*—Merchant, Gould, Smith, Edell, Welter & Schmidt

[57] ABSTRACT

A toy building is disclosed including a base member, a plurality of spaced posts are mounted on the base member and frictionally engaged with appropriately located projections. The support posts have channels in which projections extending from the base are gripped and also the ends of wall panels are engaged. The channels may have restricted zones which serve to engage the wall panels. A roof structure is superimposed over the posts and wall panels. The toy building may further include simulated overhead doors for the building, as well as, gas pumps, hoists and the like which are mounted on the base member.

12 Claims, 13 Drawing Figures

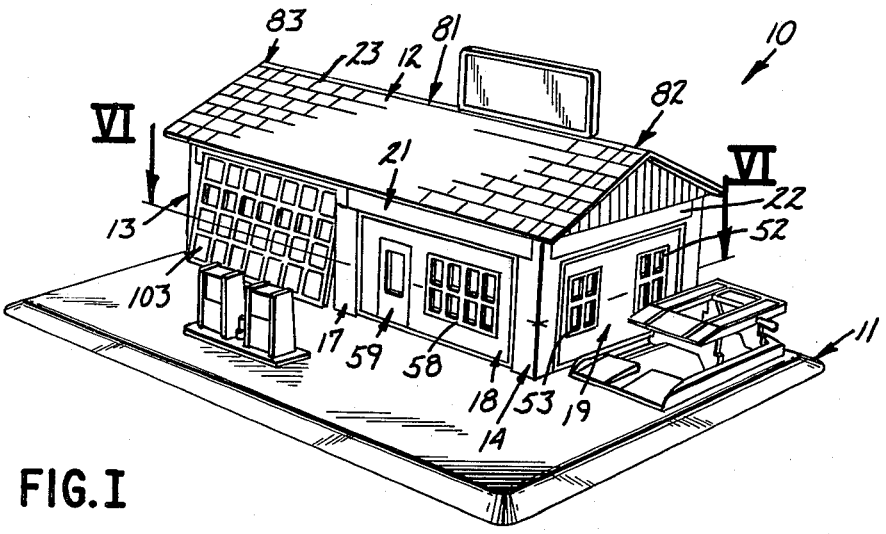
FIG. I
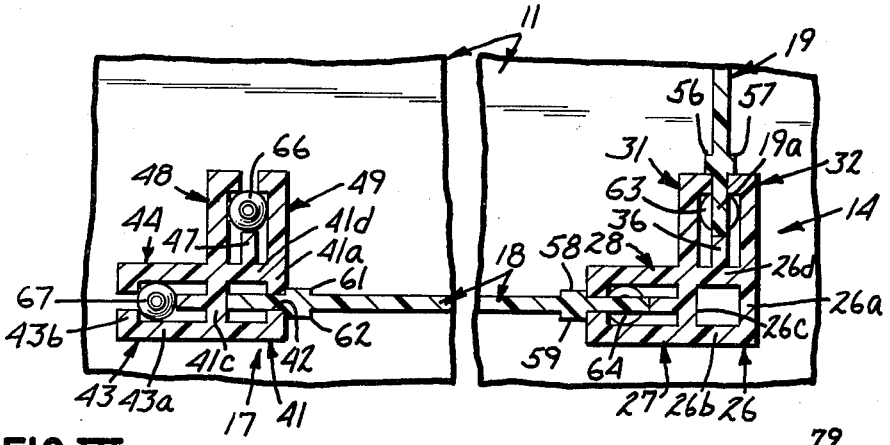
FIG. VI
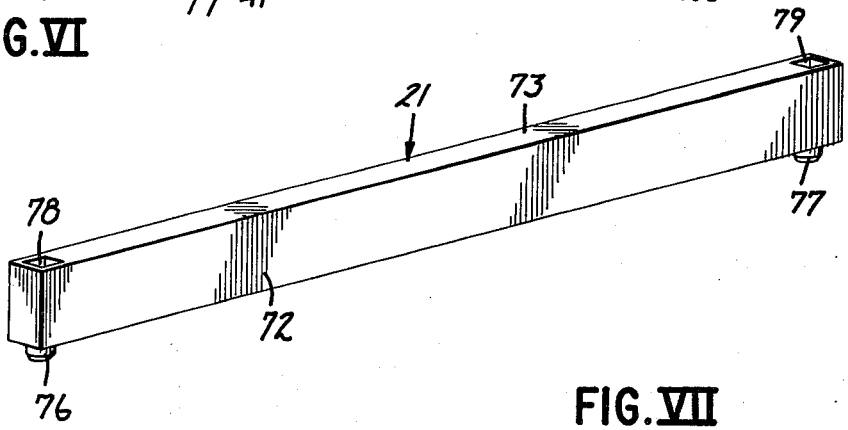
FIG. VII

FIG. II
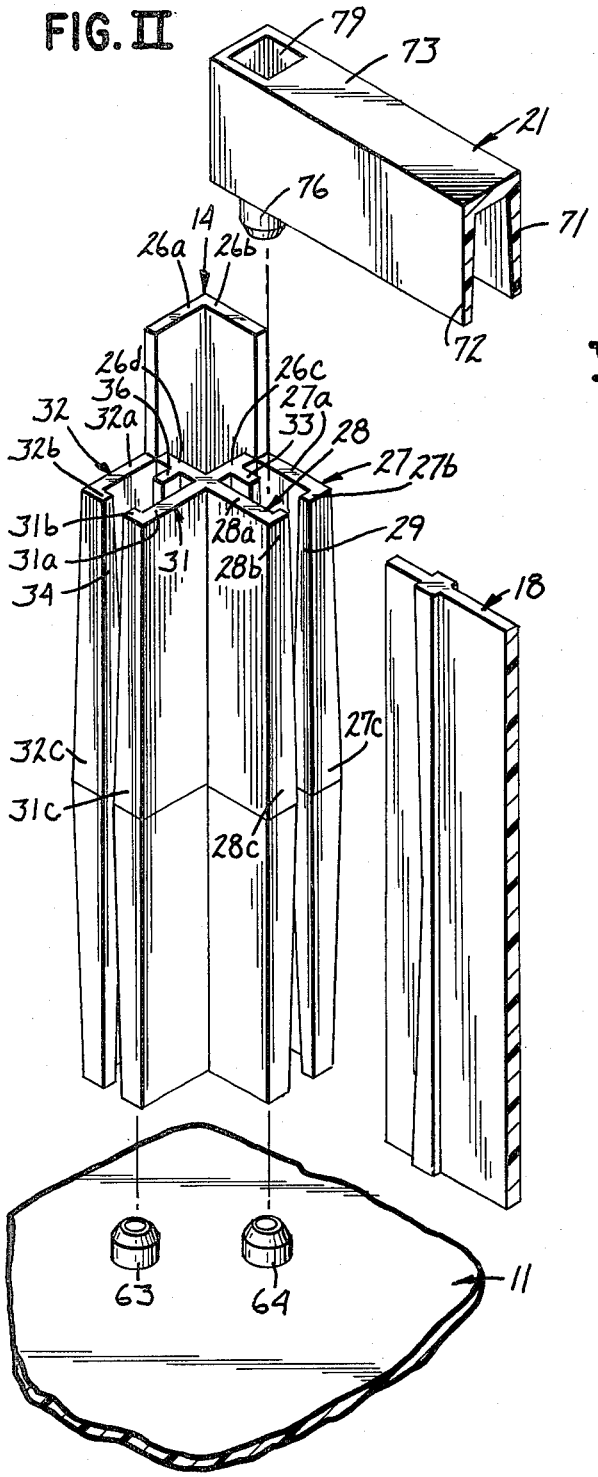
FIG. IV
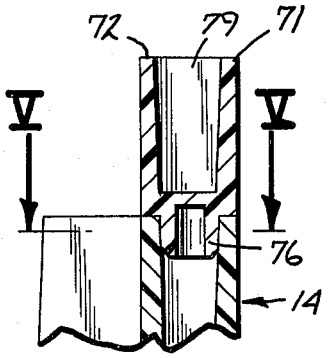
FIG. V
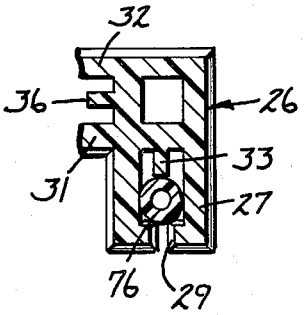

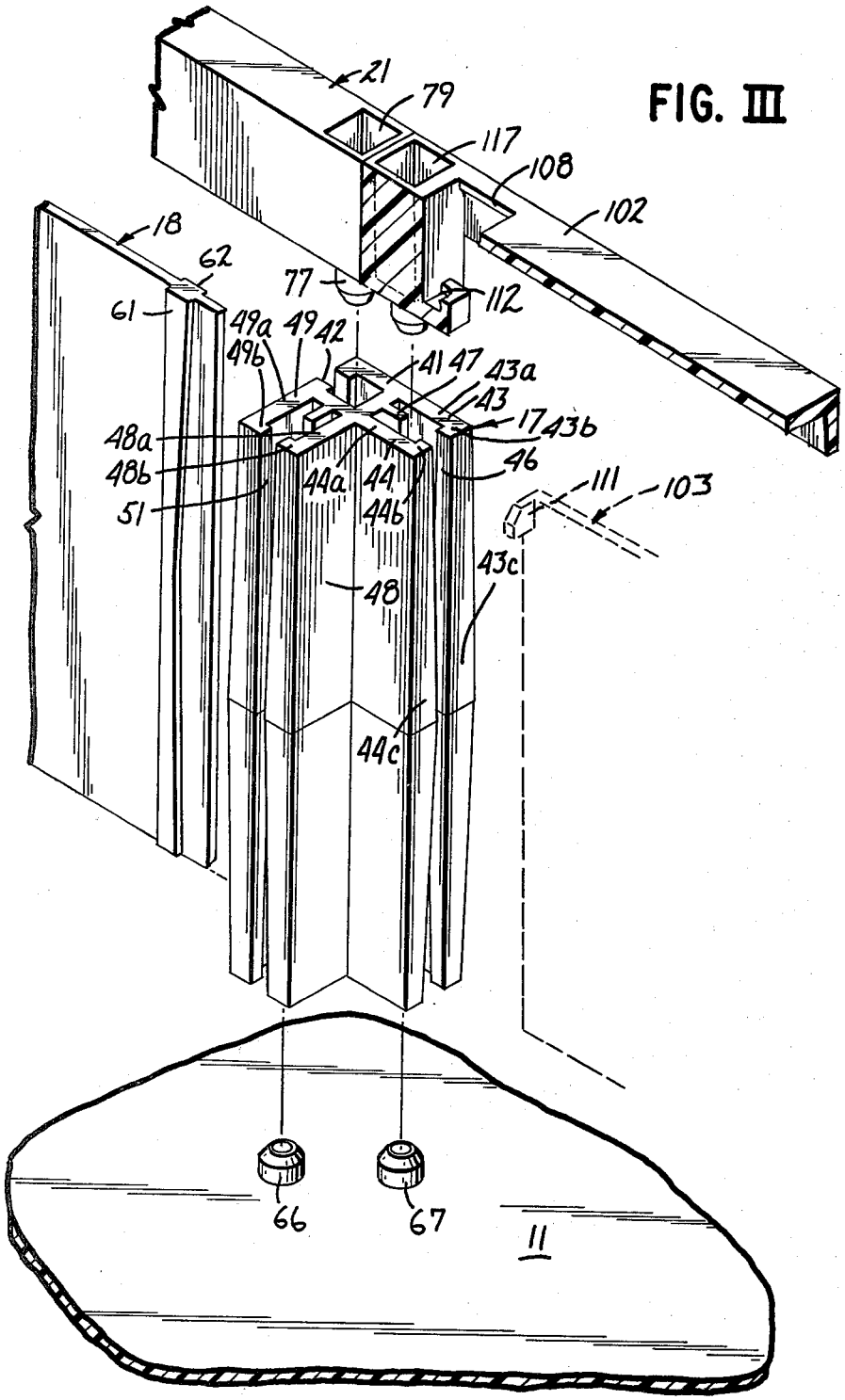
FIG. III

FIG. VIII
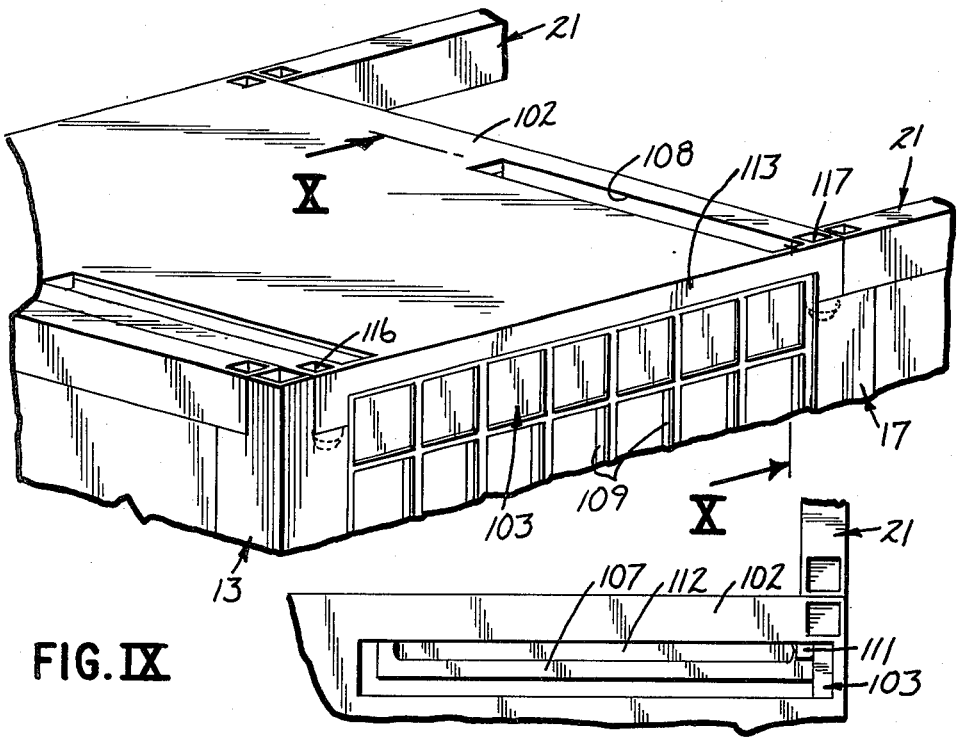
FIG. IX
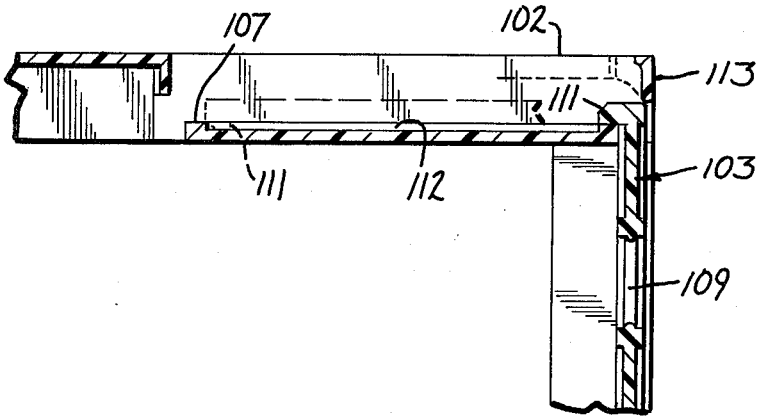
FIG. X

FIG. XI
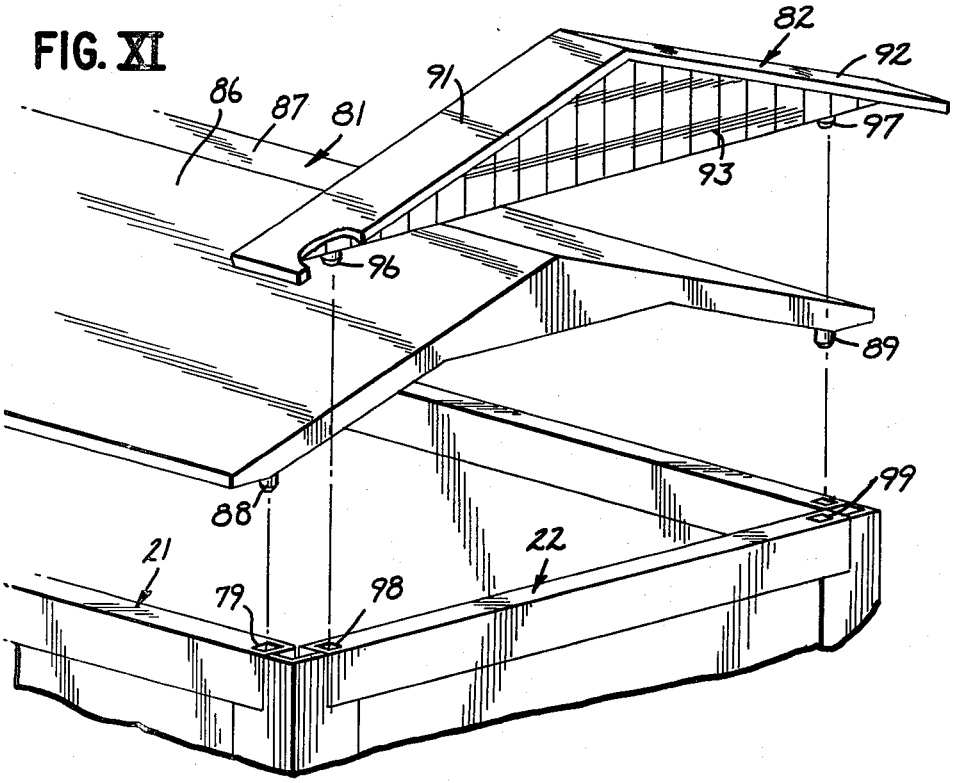
FIG. XII
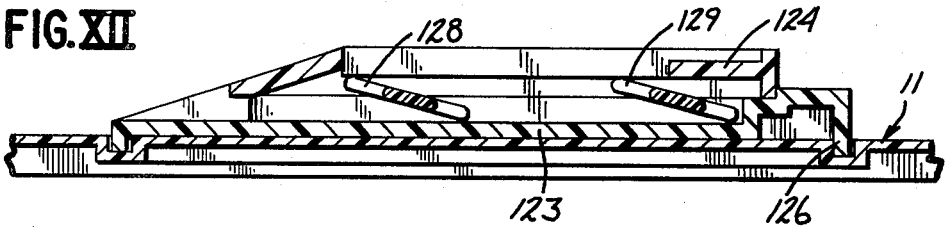
FIG. XIII
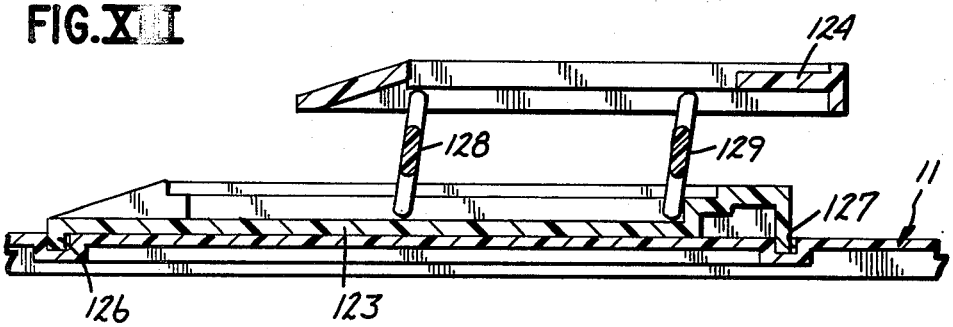

TOY BUILDING UNITS

TECHNICAL FIELD

The present invention relates to toys and more particularly to toy buildings. The toy buildings are of a type which may be assembled and disassembled at will. The structural elements of the buidling are held together by friction fit.

BACKGROUND OF PRIOR ART

One type of toy building unit that has been known for many years is the common wooden toy blocks. Historically, such building units have come in a variety of shapes, sizes and colors. One of the most common types is the small wooden block or cube, approximately 1½ inches in each dimension. Such wooden blocks have commonly had indicia such as letters cut into the surface. Most children at one time or another have stacked these blocks to form an outline of a wall or building. The wooden blocks have generally not been secured together and therefore any construction is of a very temporary nature. The primary play value in such blocks is in the stacking or assembling of the blocks rather than use of the structure subsequent to stacking.

Another general type of building unit is illustrated by the Lego TM blocks such as is shown in U.S. Pat. Nos. 3,005,282 and 3,597,875. The Lego blocks are small units which have a plurality of projections on one surface which coact with a pocket in the surface of the adjacent block. Again, the play value lies primarily in the assembling of many, many blocks into a wall construction or a building construction. The attention span of the child may be expended by the time the blocks are assembled into a building.

A further type of building block is illustrated in U.S. Pat. No. 3,076,286 in which a plurality of blocks are locked together by a dove tail insert which slides into a slot in the adjacent block. The dove tail may be an integral part of the block itself or may be a separate element which is inserted into cooperating slots in adjacent blocks.

BRIEF SUMMARY OF THE INVENTION

The present invention provides construction elements which are quickly and easily assembled to provide a building which may be utilized in conjunction with other toys such as small cars and trucks. The structural elements include a base, a plurality of support posts, a plurality of wall panels, tie beams, and a roof structure. A further element may be an overhead door. The various elements may be formed such as by plastic molding. The support posts each have at least a pair of channels with open ends. The channels of the support posts desirably have a restricted zone intermediate the ends. The support post may be secured to the base member by engagement of the ends of the channels over small projections extending from the base member. The wall panels may be frictionally engaged in such channels along the length thereof. The roof structure may include projections which are engaged in the upper open ends of the channels of the support posts. If desired, tie beams may be provided which likewise have small projections which frictionally engage in the open upper ends of the support post channels. In this case, the projections of the roof structure may be frictionally engaged in small openings or pockets in the tie beam. The present invention provides for an activity wherein the child can construct the building and yet maintain an attention span sufficient for utilizing the building after construction. Moreover, the building is of such a nature that it may be quickly disassembled and put away for storage between uses.

BRIEF DESCRIPTION OF THE DRAWINGS

FIG. 1 is a perspective view of one embodiment of the present invention;

FIG. II is an exploded view of certain elements of the present invention;

FIG. III is an exploded view of another portion;

FIG. IV shows a sectional view of a portion of the tie beam and corner post;

FIG. V shows a sectional view taken along the lines V—V in FIG. IV;

FIG. VI shows a horizontal sectional view taken along the lines VI—VI in FIG. I;

FIG. VII is a perspective view of a tie beam of the present invention;

FIG. VIII shows a perspective view of a garage door structure of the present invention;

FIG. IX is a plan view of a portion of the garage door structure;

FIG. X is a sectional view taken along the lines X—X in FIG. VIII;

FIG. XI is an exploded view showing the roof structure of the building of FIG. 1;

FIG. XII is a sectional view of the hoist of the present invention showing its relationship with the base member; and FIG. XIII is a sectional view of the hoist in another position of operation.

DETAILED DESCRIPTION OF THE PRESENT INVENTION

The building construction 10 of the present invention, one embodiment of which is illustrated in FIG. I, may include a base member 11 and a building 12. The building 12 may include a plurality of corner posts such as 13, 14 and 16 as well as intermediate posts such as 17. Wall panels 18 and 19 may be provided between the support posts. The building 12 may include horizontal tie beams 21 and 22. A roof structure 23 covers the building.

The corner posts 13, 14 and 16 may be identical, therefore only support post 14 will be described in detail. Support post 14 is best illustrated in FIGS. II and IV. Support post 14 has a square tubular portion 26 with a first pair of walls 27, 28 extending therefrom. The support post 14 includes a further pair of walls 31, 32 extending from the tubular portion 26 in a direction perpendicular to the walls 27, 28. The tubular portion 26 is made up of walls **26*a*, 26*b*, 26*c* and 26*d*. As shown in FIG. II, the walls 26*a* and 26*b* may extend upwardly beyond the ends of walls 26*c* and 26*d* equal to the depth of the tie beam 21**.

The wall 27 has a principal portion **27*a* which is attached to or is integral with the tubular portion 26. The wall 27 has an inwardly extending flange 27*b* which is illustrated in FIG. II increases in size as the center 27*c* is approached. Wall 28 is a mirror image of wall 27 including a principal wall portion 28*a* and a flange 28*b*. Flange 28*b* likewise increases in dimension as the center 28*c* is approached. A slot 29 is defined between the inner edges of flanges 27*b* and 28*b*. The width of such slot 29 narrows as the center area 27*c* and 28*c* is approached. A stub wall 33 is provided between walls 27 and 28 and aligned with slot 29. Stub wall 33** is for purposes hereinafter described.

The walls 31 and 32 may be substantially similar in construction to walls 27 and 28. Wall 31, for example, includes a principal portion 31*a* and a flange 31*b*. The size of flange 31*b* increases as the center 31*c* is approached. Wall 32 is a mirror image of wall 31 and includes a principal portion 32*a* and a flange 32*b*. Flange 32*b* likewise increases in size as the center 32*c* is approached. The flanges 31*b* and 32*b* cooperate to provide a slot 34 which becomes smaller as the center 31*c* and 32*c* is approached. A stub wall 36 is provided between walls 31 and 32.

The intermediate support post 17 may be somewhat similar in construction to corner support post 14 and is best illustrated in FIGS. III and VI. Intermediate post 17 includes a square tubular portion 41 made up of walls 41*a*, 41*b*, 41*c* and 41*d*. Wall 41*a* is discontinuous; in other words, a slot is defined in 41*a*. The width of the slot 42 may decrease as the center of the post 17 is approached in a manner similar to that described with regard to slot 29. The post 17 further includes a pair of walls 43, 44. Wall 43 includes a principal portion 43*a* and a flange 43*b*. Likewise wall 44 includes a principal portion 44*a* and a flange 44*b*. A slot 46 is defined between flange 43*b* and flange 44*b*. The slot 46 narrows as the center 43*c*, 44*c* is approached. Intermediate post 17 also includes a stub wall 47 for purposes hereinafter described. Intermediate post 17 has another pair of walls 48 and 49 constructed substantially identical to walls 43, 44 however being at right angles with respect to such walls. Wall 48 has a principal portion 48*a* and an inwardly extending flange 48*b*. Wall 49 has a principal portion 49*a* and a flange portion 49*b*. A slot 51 is defined between flange portions 48*b* and 49*b*. The slot narrows as the center of post 17 is approached as seen in FIG. III. It is to be recognized that intermediate post 17 may, if desired, be used to form a corner post in which case slot 42 is exposed or alternatively post 17 may be used as illustrated in FIG. I in an intermediate position. While in the intermediate position, post 17 may function to support an internal wall.

Wall 19, as illustrated in FIGS. I and IV, may be a substantially planar member having windows 52, 53 defined therein. The windows 52, 53 may simply be surface indicia or alternatively may be open areas whereby the child may see into the building. The wall 19 may include a pair of ridges 56, 57 adjacent each side edge. As shown in FIG. IV, the ridges 56, 57 may be spaced inwardly from the edge 19*a* of wall 19 approximately the same distance as from the outer face of flanges 27*b*, 28*b* to the edge of stub wall 36. Thus the ridges 56, 57 and the stub wall 36 limit the distance wall 19 may extend into post 14. In a similar manner wall 19 may include a pair of ridges adjacent the edge which fits into corner post 16.

Wall 18 may be similar in construction to wall 19. However, wall 18 includes a window 58 and a door 59. Door 59, if desired, may be operable to open and close. Wall 18 may be substantially planar and include a pair of ridges 58, 59 adjacent post 14 and a second pair of ridges 61, 62 adjacent intermediate post 17. The ridges 58, 59 together with stub wall 33 limit the depth whereby wall 18 may extend into post 14. Likewise ridges 61, 62 limit the depth wall 18 may extend into intermediate wall 17. It is to be noted that the spacing between the inner face of wall 41*c* of post 17 and the outer face of wall 41*a* is substantially the same as the spacing from the outer edge of stub wall 33 to the outer face of flange 31*b*.

It is to be noted that the corner post 14 and the intermediate post 17 serve as clamps for securing such post to the walls 18 and 19. In other words, the narrow center portion of slot 34 is approximately equal to or slightly narrower than the thickness of wall panel 19, whereas the wider portion of slot 34 is slightly wider than wall panel 19. This facilitates easy insertion of wall panel into slot 34 from above and yet secures the window panel with respect to the corner post. In similar manner wall panel 18 fits into slot 29 of post 14 and slot 42 of intermediate post 17.

The base member 11 may include a plurality of pairs of upwardly extending projections such as 63, 64 and 66, 67. The projections such as 63, 64 are substantially cylindrical in shape with a tappered upper end. The diameter of the cylindrical portion is appropriate for frictional engagement between the pairs of walls 27, 28 and 31, 32; such walls serving as a clamp with respect to such projections. In like manner, projections 66 and 67 are frictionally held between walls 43, 44 and 48, 49 in a clamp-like manner.

The tie beams, such as 21 (FIGS. I, II and VII) may include a pair of side walls 71, 72 and an upper wall 73. The tie beam 21 may include a pair of downwardly extending projections 76, 77 similar in structure to projections 63, 64 of base 11. The vertical dimension of side wall 17 may be substantially identical to the distance corner post walls 26*a* and 26*b* extend above the upper end of corner post walls 26*c*, 26*d*. The tie beam 21 includes a pair of upwardly opening pockets 78, 79 having an internal dimension substantially identical to or slightly greater than the diameter of the projections 76, 77. The tie beam may secure the upper ends of the support posts such as 14 and 17 together with projection 76 being frictionally held between walls 43, 44 of post 17 and projection 77 being frictionally held between walls 27, 28 of support post 14 thereby locking the upper ends of such support posts from spreading.

The roof structure 12 may include a central section 81 and a pair of end members or gables 82, 83. The central section 81 of roof 12 may include a pair of planar portions 86, 87 which have simulated shingles embossed thereon as illustrated in FIGS. I and IX. The lower side of central section 81 may have suitably located projections 88, 89 for frictional engagement in the pockets of tie beams such as pocket 79 of beam 21. The end section 82 of roof 12 may have a pair of upper surface portions 91, 92 which serve as an overhang and a vertically disposed gable section 93. The planar portions 91, 92 may be embossed with simulated shingles, whereas vertical portion 93 may be embossed with the appearance of vertical boards. The lower side of end section 82 may have a pair of downwardly extending projections 96, 97 which are suitable for engagement in pockets 98, 99 in tie beam 22.

The present building 10 may include a self-contained overhead door unit 101. The door unit 101 may include a receptacle portion 102 and a movable door portion 103 (FIGS. VIII–X). The door portion 103 may be removable from portion 102. The width of the receptacle portion 102 may be substantially identical to a tie beam such as 21. The depth may be the same as the depth of the building. Receptacle portion 102 has a plurality of downwardly extending projections 104 which serve to frictionally engage pockets such as in the corner posts and the intermediate posts as described with regard to beam 21. The receptacle portion 102 may include a pair of rails such as 106 at either side for support of the door portion 103. The rails 106 may have an upwardly extending ridge 107 which serves to retain the door 103 in proper alignment with respect to the receptacle portion 102. The receptacle portion 102 may have an upwardly opening zone 108 to enable the child to visualize how the door is tracking along the rails 106. The door portion 103 may have a plurality of windows 109 and an embossed surface that resembles the structural members of a conventional overhead door. The upper portion of door 103 has an extension 111 at either side edge which serves to track in the rail depression 112 defined by the ridge 107. The receptacle portion 102 has a forward wall 113 which limits the forward movement of the upper edge of door portion 103 such that the door does not easily separate from receptacle portion 102 but yet permits the door to move to an upper horizontal position. The receptacle portion 102 includes a plurality of upwardly opening pockets suitable for frictional reception of projections from the central roof portion 81, for example, pockets 116 and 117.

The building 10 may resemble an automobile service center including pumps 121 and an automobile hoist 122. The hoist 122 may have a lower platform member 123 and an upper platform member 124. The lower platform member may have a downwardly extending flange which extends around the perimeter thereof. The flange 126 cooperates with a plurality of slots 127 in base member 11 to hold the hoist in place. The upper platform 124 may be supported on a pair of pivotal arms 128, 129. The arms 128 and 129 may be pivotally attached to the lower platform 123 such as by a pin. In similar manner, the upper ends of arms 128 and 129 may be pivotally attached to the upper platform 124 such that upper platform 124 may be pivoted to the position illustrated in FIG. XII as the child moves a toy vehicle onto the hoist and then pivoted to the position illustrated in FIG. XIII wherein member 124 is shown raised to a point where the arms have pivoted past dead center and arm 129 is, by gravity, releasably held against an edge of member 123, so that the toy vehicle is elevated.

The gasoline pumps 121 may be mounted on base member 11 in a manner similar to that described with respect to hoist 122. In other words, the gasoline pumps 121 may have a downwardly extending flange which suitable lies in a channel defined in base member 11.

ASSEMBLY OF THE PRESENT INVENTION

Although the assembly of the present invention would be apparent from the preceding description, it will be further detailed hereinafter in order to assure a more complete understanding of the present invention. The child first positions the base member 11 in a desired location. The child then mounts the various support posts 13, 14, 16, and 17, with the projections such as 63, 64 extending into the lower ends of the channels defined by the walls of such support posts. The walls grasp the projections in a clamp-like manner. The projections are so located that the support posts are spaced appropriately for reception of corresponding wall panels therebetween. For example, wall panel 19 is inserted into the slot 34 of support post 14 and the corresponding slot in post 16. Since the upper portions of the slots have a wider dimension than the thickness of the wall panel, the wall panel 19 easily enters such slots. The child then pushes the wall panel 19 downwardly and the restricted central portion **31*c* and 32*c* of support post 14 secures the wall panel in a clamp-like manner. After each of the wall panels are appropriately in place, the tie beams 21 and 22 are secured in place with the projections from such tie beams engaging the upper ends of the support posts. The walls of the support posts grasp such projections in a clamplike manner. The child may place door 103 into receptacle 102. The overhead door unit 101 is next mounted in place. Next the roof section 81 is mounted together with the end sections 82 and 83 of the roof 12. Finally, the gasoline pumps 121 and the automobile hoist 122** are placed in position. The building is now ready for use by the child while playing with toy vehicles. Of course, various modifications may be made to the present building without departing from the broader scope of the present invention. The building may be provided as modules to alternatively form single or multiple story structures. The upper stories may serve various functions such as that of a parking ramp. The building may be an automotive service center, a car wash or a parking garage.

What is claimed is:

1. A toy building construction comprising:

a base member, a plurality of spaced upstanding support posts mounted on said base member, a plurality of wall panels, each of said panels being fitted between a pair of said support posts, and a roof structure mounted above said support posts and wall panels, said base member including a plurality of pairs of upwardly extending projections, each pair of said projections being adapted to coact with one of said support posts to frictionally secure said support post to said base in a clamp-like manner, said support posts each including wall means defining at least a pair of channels extending the length of said support post, said wall means serving to frictionally engage one of said projections in the end of each of said pair of channels, said wall means further serving to entrap one end of one of said wall panels in one of said channels.

2. The toy building construction of claim 1 wherein said post channels each include a restricted zone intermediate the ends of said post.

3. The toy building construction of claim 2 including roof structure having a plurality of pairs of downwardly extending projections to frictionally secure said roof structure with respect to said support posts.

4. The toy building construction of claim 3 further including a plurality of horizontal tie beams, each of said tie beams extending from one support post to the next support post, each of beams having a downwardly extending projection adjacent each end for frictional engagement in the upper end of one of said channels of the respective support post thereby tieing together the upper ends of adjacent support posts.

5. The toy building construction of claim 4 wherein the horizontal tie beams each include a pair of upwardly opening pockets, one of said pockets being located near each end of said beam, and wherein said downwardly extending projections of the roof structure are frictionally engaged in said upwardly opening pockets.

6. The toy building construction of claim 2 wherein the wall means of said support posts define three channels in each of said posts, wherein said posts may selectively serve as a corner post and as an intermediate wall post.

7. The toy building construction of claim 1 wherein the wall means of said support posts define three channels in each of said posts, wherein said posts may selectively serve as a corner post and as an intermediate wall post.

8. The toy building construction of claim 7 wherein said toy building construction resembles an automobile service station and wherein said base member has slots defining a rectangle, said service station including simulated gasoline pumps, said pumps being held in said slot rectangle.

9. The service station of claim 8 wherein said base member includes a second set of slots defining a second rectangle, said service station including a simulated automobile hoist, said hoist being held in said second slot rectangle.

10. The service station of claim 9 wherein said hoist comprises a base portion which interfits into the base of the service station, a platform suitable for supporting a toy automobile, and two pairs of arms, the ends of said arms being pivotally attached to said hoist base and other ends of said arms being pivotally attached to said platform, said platfrom being pivotally movable on said arms from a first position in which said platform lies closely adjacent said hoist base to a second position in which the platform is elevated above said hoist base, said hoist further including means for releasably holding said platform in the elevated position.

11. The toy building construction of claim 10 wherein said construction further includes a plurality of horizontal tie beams, each of said tie beams including a downwardly extending projection adjacent each end for interlocking in the upper end of one of said channels and wherein the horizontal tie beams each include a pair of upwardly opening pockets said pockets being adapted for interfitting with the downwardly extending projections of said roof structure.

12. Toy building construction comprising a base member, a plurality of upstanding support posts, a plurality of wall panels interfitting between said support posts and a roof structure, said base member including a plurality of pairs of upstanding projections, each pair of said projections being adapted to coact with one of said support posts to frictionally lock said post to said base, each of said support posts including at least a pair of channels extending the length of said post, each channel of said pair serving to frictionally engage opposed surfaces of one of said projections and also serving to engage one edge of one of said wall panels, said roof structure including a plurality of pairs of downwardly extending projections to frictionally engage means at the upper ends of said support post channels.

* * * * *